US007663577B2

(12) United States Patent
Yoon

(10) Patent No.: US 7,663,577 B2
(45) Date of Patent: Feb. 16, 2010

(54) ORGANIC LIGHT EMITTING DISPLAY DEVICE

(75) Inventor: Han-Hee Yoon, Suwon-si (KR)

(73) Assignee: Samsung Mobile Display Co., Ltd., Yongin (KR)

( * ) Notice: Subject to any disclaimer, the term of this patent is extended or adjusted under 35 U.S.C. 154(b) by 735 days.

(21) Appl. No.: 11/460,653

(22) Filed: Jul. 28, 2006

(65) Prior Publication Data

US 2007/0035485 A1 Feb. 15, 2007

(30) Foreign Application Priority Data

Aug. 12, 2005 (KR) ..... 10-2005-0074366

(51) Int. Cl.
*G09G 3/30* (2006.01)

(52) U.S. Cl. ..... 345/76; 345/1

(58) Field of Classification Search ..... 345/1, 345/76, 207; 340/717; 257/758
See application file for complete search history.

(56) References Cited

U.S. PATENT DOCUMENTS 5,105,183 A * 4/1992 Beckman ..... 345/1.3
5,523,769 A * 6/1996 Lauer et al. ..... 345/1.3
6,014,116 A * 1/2000 Haynes et al. ..... 345/1.1
7,378,739 B2 * 5/2008 Kwak et al. ..... 257/758
2005/0083323 A1 * 4/2005 Suzuki et al. ..... 345/207

FOREIGN PATENT DOCUMENTS

KR 1020050081473 A1 8/2005

* cited by examiner

*Primary Examiner*—Amare Mengistu
*Assistant Examiner*—Yuk Chow
(74) *Attorney, Agent, or Firm*—H.C. Park & Associates, PLC

(57) ABSTRACT

An organic light emitting display (OLED) device including a plurality of electroluminescent (EL) panels that are coupled with one another. In order to facilitate the coupling of the EL panels, respective data drivers are disposed at one side of pixels, and a scan driver and an emission control driver are formed in each of the EL panels. Thus, surfaces of the EL panels that are not connected to data drivers may be coupled with one another to form the OLED device. In the OLED device, a data driver is not formed at interfaces between the EL panels, and uniform pixels are arranged, so that non-uniformity in luminance may be prevented.

20 Claims, 5 Drawing Sheets

ORGANIC LIGHT EMITTING DISPLAY DEVICE

CROSS-REFERENCE TO RELATED APPLICATION

This application claims priority to and the benefit of Korean Patent Application No. 10-2005-0074366, filed Aug. 12, 2005, which is incorporated herein by reference for all purposes as if fully set forth herein.

BACKGROUND OF THE INVENTION

1. Field of the Invention

The present invention relates to an organic light emitting display (OLED) device, and more particularly, to an OLED device in which a plurality of electroluminescent (EL) panels are coupled together.

2. Discussion of the Background

Flat panel display (FPD) devices are being actively researched. Organic light emitting display (OLED) devices have particularly attracted much attention as next-generation FPDs because of their high luminance and wide viewing angle.

Unlike liquid crystal display (LCD) devices, the OLED devices do not need an additional light source because they utilize self-emissive light emitting diodes. The intensity of light emitted from light emitting diodes corresponds to the amount of driving current supplied to an electrode of the diode.

FIG. 1 shows a conventional OLED device.

Referring to FIG. 1, a conventional OLED device may include a pixel portion 10, a scan driver 20, a data driver 30, and an emission control driver 40.

The scan driver 20 sequentially supplies scan signals to scan lines $S_1$-$S_n$ in response to scan control signals (i.e., a start pulse and a clock signal) output from a timing controller (not shown).

The data driver 30 applies data voltages corresponding to red (R), green (G), and blue (B) data to data lines $D_1$-$D_m$ in response to data control signals output from the timing controller.

The emission control driver 40 includes shift registers and it sequentially supplies emission control signals to emission control lines $E_1$-$E_n$ in response to the start pulse and the clock signal output from the timing controller.

The pixel portion 10 includes a plurality of pixels $P_{11}$-$P_{nm}$, which are located in regions where a plurality of scan lines $S_1$-$S_n$ and a plurality of emission control lines $E_1$-$E_n$ cross with a plurality of data lines $D_1$-$D_m$. The pixel portion 10 displays a predetermined image according to an applied data voltage.

Each pixel $P_{11}$-$P_{nm}$ includes a R, G, and B sub-pixel.

The R, G, and B sub-pixels have the same pixel circuit construction, and they emit R, G, and B light, respectively, that corresponds to the current supplied to each organic light emitting diode. Thus, each pixel $P_{11}$-$P_{nm}$ combines light emitted by the R, G, and B sub-pixels to display a specific color.

In such an OLED device, it is difficult to increase the panel's size because an IR drop occurs depending on the length of a line to which a power supply voltage is applied, and production equipment is affected by the panel's size. In order to solve these problems, an OLED device using a tiling technique was proposed to increase panel size by bonding a plurality of panels.

However, the conventional OLED device may be inadequate to the bonding of the panels since drivers, such as the data driver 30, the scan driver 20, and the emission control driver 40, are typically formed at multiple sides of the pixel portion 10. Also, the OLED device may have non-uniform luminance at interfaces between bonded panels.

SUMMARY OF THE INVENTION

The present invention provides an organic light emitting display (OLED) device in which data, scan, and emission control drivers are arranged so that multiple electroluminescent (EL) panels may be more easily bonded together.

Additional features of the invention will be set forth in the description which follows, and in part will be apparent from the description, or may be learned by practice of the invention.

The present invention discloses an OLED device in which a plurality of EL panels are coupled together to display a predetermined image. The device includes a pixel portion having a plurality of pixels to display an image, and a plurality of data driving circuits spaced a predetermined distance apart from one another to transmit a data signal to the pixel portion. A scan driver is arranged between the data driving circuits and the pixel portion, and it is disposed on a substrate on which the pixel portion is disposed. An emission control driver is arranged between the data driving circuits and the pixel portion, and it is disposed on the substrate on which the pixel portion is disposed. A plurality of data lines transmit the data signal to the pixel portion, and a plurality of scan lines extend from the scan driver to the pixel portion, and are disposed parallel to the data lines to transmit a scan signal to the pixel portion. A plurality of emission control lines extend from the emission control driver to the pixel portion, and are disposed parallel to the scan lines to transmit an emission control signal to the pixel portion. Power supply voltage lines extend from a power supply pad portion, which is disposed between adjacent data driving circuits, to the pixel portion, and are disposed parallel to the emission control lines to transmit a power supply voltage to the pixel portion.

The present invention also discloses an EL panel for an OLED device, which includes a plurality of EL panels coupled together and receives a data signal from a plurality of data driving circuits that are spaced a predetermined distance apart from one another to display an image. The EL panel includes a pixel portion having a plurality of pixels to display an image, and a plurality of scan signal generating circuits arranged between the data driving circuits and the pixel portion, spaced a predetermined distance apart from one another, and disposed on a substrate on which the pixel portion is disposed. A plurality of emission control signal generating circuits are arranged between the data driving circuits and the pixel portion, and are spaced a predetermined distance apart from one another on the substrate on which the pixel portion is disposed. A plurality of data lines transmit a data signal to the pixel portion, and a plurality of scan lines extend from the scan signal generating circuits to the pixel portion, and are disposed parallel to the data lines to transmit a scan signal to the pixel portion. A plurality of emission control lines extend from the emission control signal generating circuits to the pixel portion, and are disposed parallel to the scan lines to transmit an emission control signal to the pixel portion. Power supply voltage lines extend from a power supply pad portion, which is disposed between adjacent data driving circuits, to the pixel portion, and are disposed parallel to the emission control lines to transmit a power supply voltage to the pixel portion.

The present invention also discloses an OLED device including a plurality of OLED arrays coupled together. Here, an OLED array includes a data driver coupled with an EL panel. The EL panel includes a pixel portion having a plurality of pixels to display an image, a first driver arranged between the data driver and the pixel portion and disposed on the same substrate as the pixel portion, and a second driver arranged between the first driver and the pixel portion and disposed on the same substrate as the pixel portion. Data lines transmit a data signal from the data driver to the pixel portion, and first lines extend from the first driver to the pixel portion to transmit a first signal to the pixel portion. The first lines are disposed substantially parallel to the data lines. Second lines extend from the second driver to the pixel portion to transmit a second signal to the pixel portion, and the second lines are disposed substantially parallel to the first lines.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention, and together with the description serve to explain the principles of the invention.

DETAILED DESCRIPTION OF THE ILLUSTRATED EMBODIMENTS

Figure 1:
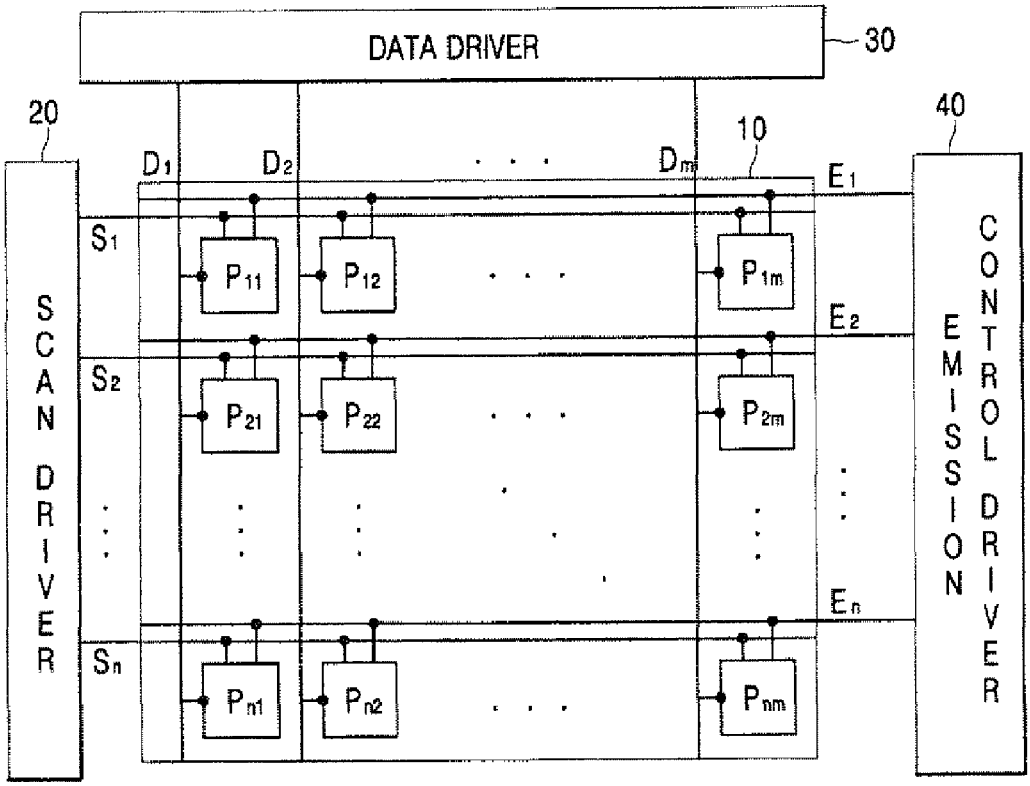
FIG. 1 (BACKGROUND ART)
FIG. 1 shows a conventional organic light emitting display (OLED) device.

The present invention is described more fully hereinafter with reference to the accompanying drawings, in which exemplary embodiments of the invention are shown. This invention may, however, be embodied in many different forms and should not be construed as limited to the embodiments set forth herein. Rather, these embodiments are provided so that this disclosure is thorough, and will fully convey the scope of the invention to those skilled in the art. In the drawings, the size and relative sizes of layers and regions may be exaggerated for clarity. Like reference numerals in the drawings denote like elements.

It will be understood that when an element such as a layer, film, region or substrate is referred to as being "on" another element, it can be directly on the other element or intervening elements may also be present. In contrast, when an element is referred to as being "directly on" another element, there are no intervening elements present.

Figure 2:
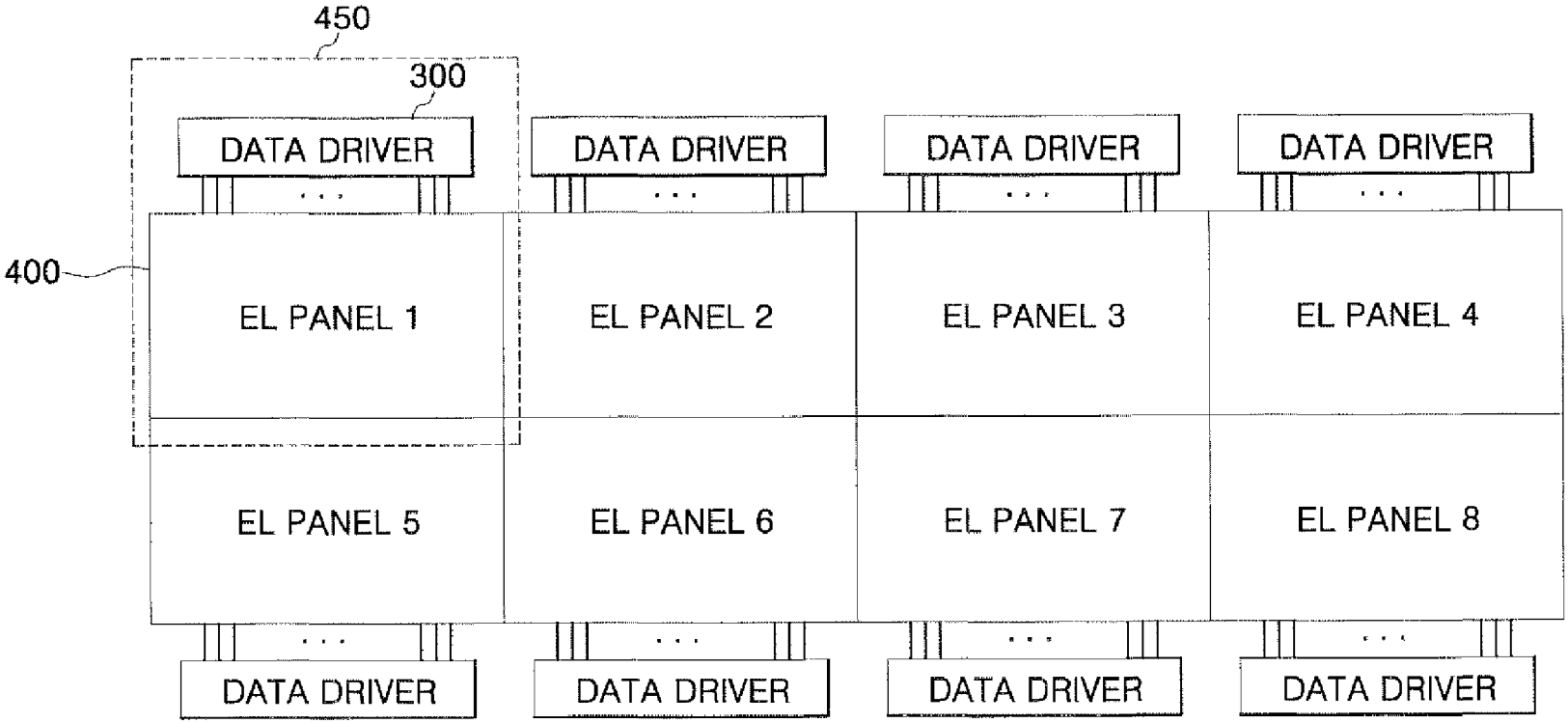
FIG. 2 shows an OLED device according to an exemplary embodiment of the present invention.

FIG. 2 shows an organic light emitting display (OLED) device according to an exemplary embodiment of the present invention.

Referring to FIG. 2, the OLED device includes a panel, which includes a plurality of bonded electroluminescent (EL) panels 1-8, and data drivers 1-8, which are coupled with EL panels 1-8, respectively.

An EL panel 400 and a data driver 300 coupled with the EL panel 400 form an OLED array 450, and the OLED device includes a plurality of OLED arrays 450.

Each EL panel 400 may be electrically coupled with a data driver 300 through a metal pattern that is printed on a flexible film. That is, an output terminal of the data driver 300 is electrically coupled with one end of the metal pattern, and a data line disposed on the EL panel 400 is electrically coupled with the other end of the metal pattern.

Each data driver 300 supplies data signals, in response to data control signals from a timing controller (not shown), to a pixel portion through a plurality of conductive lines disposed on the flexible film. The data signals are applied through the conductive lines to 24 red (R), green (G), and blue (B) subpixels that are disposed on 8 pixel lines arranged in a vertical direction. Each EL panel 400 is coupled with 60 conductive lines so that the data signals are applied to respective pixels of the EL panel 400.

Also, each EL panel 400 includes a circuit that generates a scan signal for selecting a pixel and an emission control signal for controlling the pixel's emission. Accordingly, neither a scan signal generator nor an emission control signal generator need to be additionally installed.

The EL panels 400 may be fabricated using a similar process that is used to fabricate panels of a conventional OLED device. Thus, the plurality of EL panels 400 may be fabricated by the same process and bonded to one another to form a single panel.

Since the EL panels 400 may be fabricated using the same mask, they can have thin film transistors (TFTs) with substantially the same size. Also, a TFT of each pixel may include a polysilicon (poly-Si) channel in order to obtain fast response speed and high uniformity. In this case, the poly-Si channel may be fabricated by forming an amorphous silicon (a-Si) layer on a glass substrate and crystallizing the a-Si layer into a poly-Si layer using a low temperature poly-Si (LTPS) process. When the LTPS process uses different laser shots, there may be differences in threshold voltage and mobility in the resultant pixels. Therefore, the EL panels 400, which may be fabricated by the above-described same process, include TFTs that are formed using the same laser shot, so that the single panel obtained by bonding the EL panels 400 may have substantially uniform pixels.

Each EL panel 400 may be bonded to adjacent EL panels 400 using ultraviolet (UV)-curing resin or thermal curing resin, specifically, epoxy resin. Surfaces of the EL panels 400 that are not coupled with the data drivers 300 may be bonded to one another, thus forming a large-sized panel. Accordingly, when each EL panel 400 has four surfaces, up to three surfaces may be used for bonding.

Figure 3:
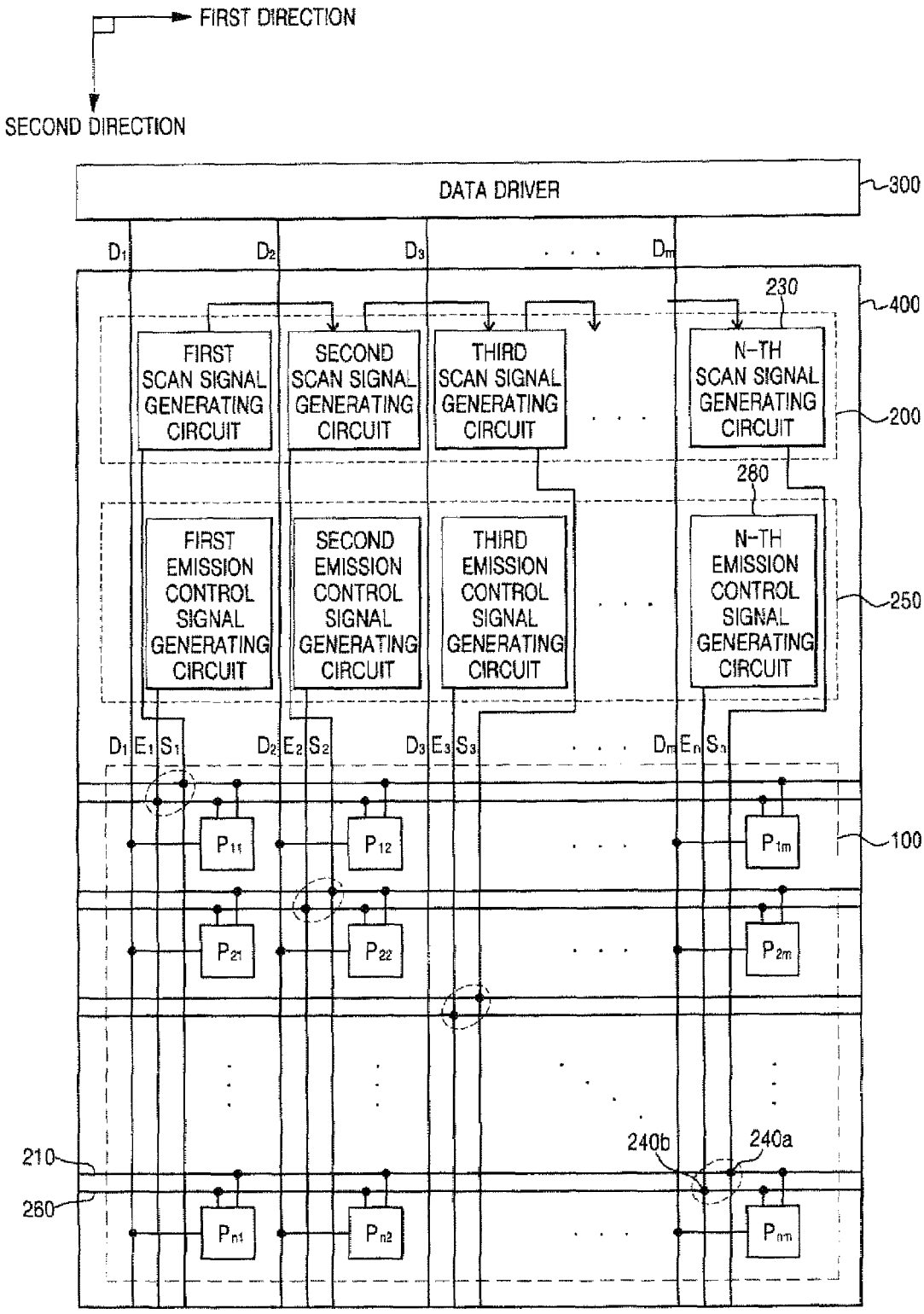
FIG. 3 shows an OLED array according to an exemplary embodiment of the present invention.

FIG. 3 shows an OLED array according to an exemplary embodiment of the present invention.

Referring to FIG. 3, the OLED array includes an EL panel 400 and a data driver 300. The EL panel 400 includes a pixel portion 100, a scan driver 200, and an emission control driver 250.

In FIG. 3, pixels that are enabled in response to an n-th scan signal are arranged in the first direction, and the second direction is substantially perpendicular to the first direction.

The EL panel 400 may be coupled with the data driver 300 through a flexible film.

The scan driver 200 is disposed in the EL panel 400 and interposed between the data driver 300, which is disposed outside the EL panel 400, and the pixel portion 100, which is disposed in the EL panel 400. Therefore, the drivers 200, 250, and 300, which supply a scan signal, an emission control signal, and a data signal, respectively, may be positioned at one side of the pixel portion 100 so that a single OLED device may be fabricated by bonding a plurality of EL panels 400.

The scan driver 200 includes a plurality of scan signal generating circuits 230, which are spaced part from one another and generate respective scan signals. The scan signal generating circuits 230 may be formed using p-type metal oxide semiconductor field effect transistors (MOSFETs) obtained by the same fabricating process as TFTs for the pixel portion 100.

The scan signal generating circuits 230 receive scan control signals (i.e., a power supply voltage and clock signals) for driving the scan driver 200 from a timing controller (not shown) and generate respective scan signals. The scan signal generating circuits 230 may be formed at regular intervals in the first direction.

Thus, scan lines $S_n$ extend from the respective scan signal generating circuits 230 and run across the pixel portion 100 in the second direction. The scan lines $S_n$ enable pixels $P_{n1}$-$P_{nm}$, which are disposed in the first direction, using one scan signal. Accordingly, the scan lines $S_n$ are respectively coupled with the pixels $P_{n1}$-$P_{nm}$, which are disposed in the first direction, using conductive lines 210, which extend in the first direction to cross the scan lines $S_n$.

The emission control driver 250 is disposed in the EL panel 400 and interposed between the pixel portion 100 and the scan driver 200, which are also disposed in the EL panel 400. The emission control driver 250 includes a plurality of emission control signal generating circuits 280, which are spaced apart from one another and generate respective emission control signals. The emission control signal generating circuits 280 may be formed using p-type MOSFETs obtained by the same fabricating process as the TFTs for the pixel portion 100.

The emission control signal generating circuits 280 receive a power supply voltage and clock signals from the timing controller, receive scan signals from the scan signal generating circuits 230, and output emission control signals to the pixel portion 100. The emission control signal generating circuits 280 may be formed at regular intervals in the first direction. Also, an n-th scan signal generating circuit 230 is coupled with an n-th emission control signal generating circuit 280 and supplies a scan signal to the n-th emission control signal generating circuit 280.

Thus, emission control lines $E_n$ extend from the emission control signal generating circuits 280 and run across the pixel portion 100 in the second direction. The emission control lines $E_n$ control light emitting of the pixels $P_{n1}$-$P_{nm}$, which are disposed in the first direction, using one emission control signal. Accordingly, the emission control lines $E_n$ are respectively coupled with the pixels $P_{n1}$-$P_{nm}$, which are disposed in the first direction, using conductive lines 260, which extend in the first direction to cross the emission control lines $E_n$.

The scan driver 200 and the emission control driver 250 may exchange positions.

The EL panel 400 includes a plurality of data lines $D_1$-$D_m$, which couple the data driver 300 with the pixel portion 100 and transmit data signals to the respective pixels. The data lines $D_1$-$D_m$ are arranged in spaces between adjacent scan signal generating circuits 230 and adjacent emission control signal generating circuits 280. Consequently, the data lines $D_1$-$D_m$ may have a minimal length, thus reducing signal delay.

The pixel portion 100 includes a plurality of pixels $P_{11}$-$P_{nm}$, each of which includes a R, G, and B sub-pixel. That is, each of the pixels $P_{11}$-$P_{nm}$ is formed by regularly repeating the R, G, and B sub-pixels in the first and second directions.

The pixels $P_{11}$-$P_{nm}$ may have various alternative arrangements. For example, even if the R, G, and B sub-pixels are arranged in stripe patterns in the first direction, they may be arranged in different forms in the second direction, or the pixels $P_{11}$-$P_{nm}$ may be arranged in mosaic forms.

In each pixel $P_{11}$-$P_{nm}$, the R, G, and B sub-pixels have the same pixel circuit construction. The R, G, and B sub-pixels emit R, G, and B light, respectively, at an intensity corresponding to the current supplied to an organic light emitting diode. Accordingly, each pixel $P_{11}$-$P_{nm}$ combines light emitted by the R, G, and B sub-pixels to display a specific color.

In the pixel portion 100, a plurality of scan lines $S_1$-$S_n$, data lines $D_1$-$D_m$, and emission control lines $E_1$-$E_n$ extend in the second direction.

Also, the conductive lines 210 and 260 are arranged extending in the first direction across the scan lines $S_1$-$S_n$ and the emission control lines $E_1$-$E_n$ in order to couple the scan lines $S_1$-$S_n$ and the emission control lines $E_1$-$E_n$ with the respective pixels $P_{11}$-$P_{nm}$. The scan line $S_1$, which transmits a first scan signal, is electrically coupled with the conductive line 210 through a contact hole 240*a* in the pixel $P_{11}$. Accordingly, the contact hole 240*a* is formed in each diagonally arranged pixel $P_{11}$, $P_{22}$, $P_{33}$, . . . , and $P_{nn}$ on the pixel portion 100. Also, the emission control line $E_1$, which transmits a first emission control signal, is electrically coupled with the conductive line 260 through a contact hole 240*b* on the pixel $P_{11}$. Accordingly, the contact hole 240*b* is formed in each diagonally arranged pixel $P_{11}$, $P_{22}$, $P_{33}$, . . . , and $P_{nn}$ on the pixel portion 100.

Each pixel $P_{11}$-$P_{nm}$ receives a scan signal and an emission control signal through the conductive lines 210 and 260, respectively, and receives a data signal through a data line $D_1$-$D_m$ to display a predetermined image.

Figure 4:
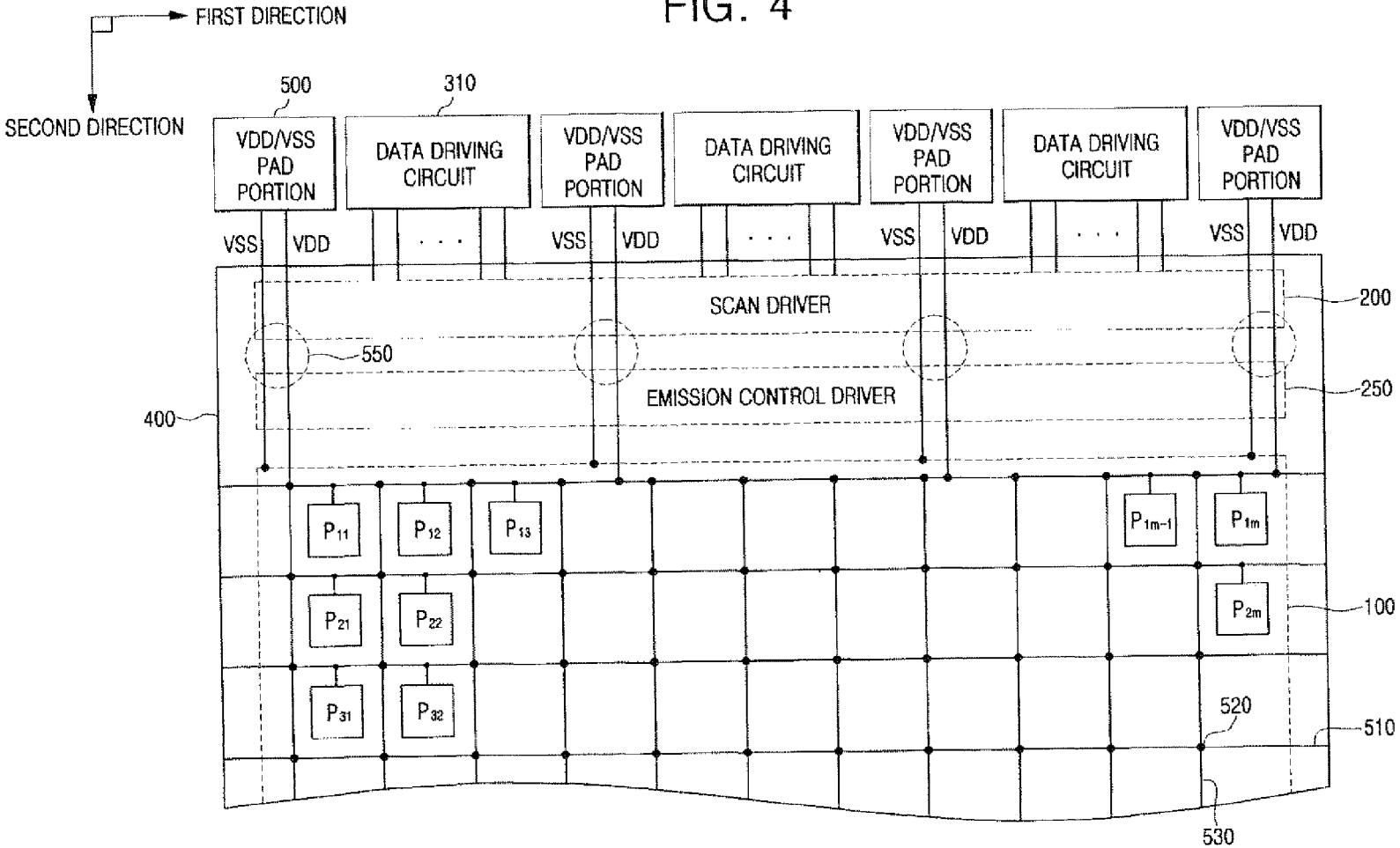
FIG. 4 shows an OLED array according to another exemplary embodiment of the present invention.

FIG. 4 shows an OLED array according to another exemplary embodiment of the present invention.

Referring to FIG. 4, the OLED array includes an EL panel 400, a plurality of data driving circuits 310, and a plurality of VDD/VSS pad portions 500. The EL panel 400 includes a pixel portion 100, a scan driver 200, and an emission control driver 250.

In FIG. 4, pixels that are enabled in response to an n-th scan signal are arranged in the first direction, and the second direction is substantially perpendicular to the second direction. Since the pixel portion 100, the scan driver 200, and the emission control driver 250 are the same as described with reference to FIG. 3, a description thereof will not be repeated here.

The EL panel 400 is electrically coupled with the plurality of data driving circuits 310 to form a single OLED array 450 shown in FIG. 2

The data driving circuits 310 are spaced apart from one another. Each data driving circuit 310 may be electrically coupled with the EL panel 400 through a metal pattern that is printed on a flexible film. That is, an output terminal of the data driving circuit 310 may be electrically coupled with one end of the metal pattern, and a data line disposed on the EL panel 400 may be electrically coupled with the other end of the metal pattern.

The data driving circuits 310 are coupled with data lines in a number equal to the number of the data driving circuits 310 through the same metal pattern. Each data driving circuit 310 transmits a data signal to the pixel portion 100 through a plurality of conductive lines that are disposed on the flexible film. The conductive lines transmit the data signals to 24 R, G, and B sub-pixels that are placed on 8 pixel lines arranged in the second direction. Each data driving circuit 310 transmits the data signal to 20 conductive lines.

When one EL panel 400 is coupled with three data driving circuits 310, it is coupled with 60 conductive lines so that the data signals are applied to respective pixels of the EL panel 400.

The plurality of VDD/VSS pad portions 500 are arranged in spaces between the data driving circuits 310. The VDD/VSS pad portions 500 are coupled with the EL panel 400 and apply power supply voltages VDD and VSS to the pixel portion 100. Thus, power supply interconnection groups 550 are formed on the EL panel 400. Each power supply interconnection group 550 includes a first power supply line, which transmits a positive power supply voltage VDD to the pixel portion 100, and a second power supply line, which transmits a negative power supply VSS to the pixel portion 100. The first and second power supply lines make a pair and are arranged extending in the second direction substantially in parallel to one another.

The first and second power supply lines are coupled with the EL panel 400, so that they are coupled with the VDD/VSS pad portions 500 and receive the power supply voltages VDD and VSS from the VDD/VSS pad portions 500. When the first and second power supply lines are arranged between the data driving circuits 310, a distance from the VDD/VSS pad portions 500 to the pixel portion 100 may be minimized, thus reducing a voltage drop.

A plurality of first power supply lines are coupled with conductive lines 510 and 530, which are arranged in a matrix on the pixel portion 100 and transmit a positive power supply voltage VDD to the respective pixels $P_{11}$-$P_{nm}$. Thus, the first power supply lines may transmit the positive power supply voltage VDD to the pixels $P_{11}$-$P_{nm}$. That is, the conductive line 510, which is disposed in the pixel portion 100 across the pixels $P_{11}$-$P_{1n}$ that are enabled in response to a first scan signal, is coupled with the plurality of first power supply lines and receives the positive power supply voltage VDD. A plurality of conductive lines 510 disposed in the first direction are coupled with the first power supply lines that apply the same positive power supply voltage VDD. Thus, the positive power supply voltage VDD may be applied to all pixels $P_{11}$-$P_{1n}$ without causing a substantial voltage drop due to the length of the conductive lines 510. Also, a plurality of conductive lines 530 are arranged in the second direction and coupled with the conductive lines 510. The conductive lines 530 receive the positive power supply voltage VDD from the conductive lines 510 and apply the positive power supply voltage VDD to the respective pixels $P_{11}$-$P_{nm}$. The second-directional conductive lines 530 intersect the first-directional conductive lines 510 and are electrically coupled with the conductive lines 510 through contact holes 520. Accordingly, the first-directional conductive lines 510 and the second-directional conductive lines 530 are arranged in a matrix on the pixel portion 100 and may apply the positive power supply voltage VDD to all pixels $P_{11}$-$P_{nm}$ without causing a substantial voltage drop.

Also, a plurality of second power supply lines, which transmit a negative power supply voltage VSS to the pixel portion 100, are coupled with a cathode that may be formed on the entire surface of the pixel portion 100. Thus, the negative power supply voltage VSS may be applied through the second power supply lines to the cathode. Accordingly, the negative power supply voltage VSS may be applied to the entire surface of the cathode without causing a substantial voltage drop.

Figure 5:
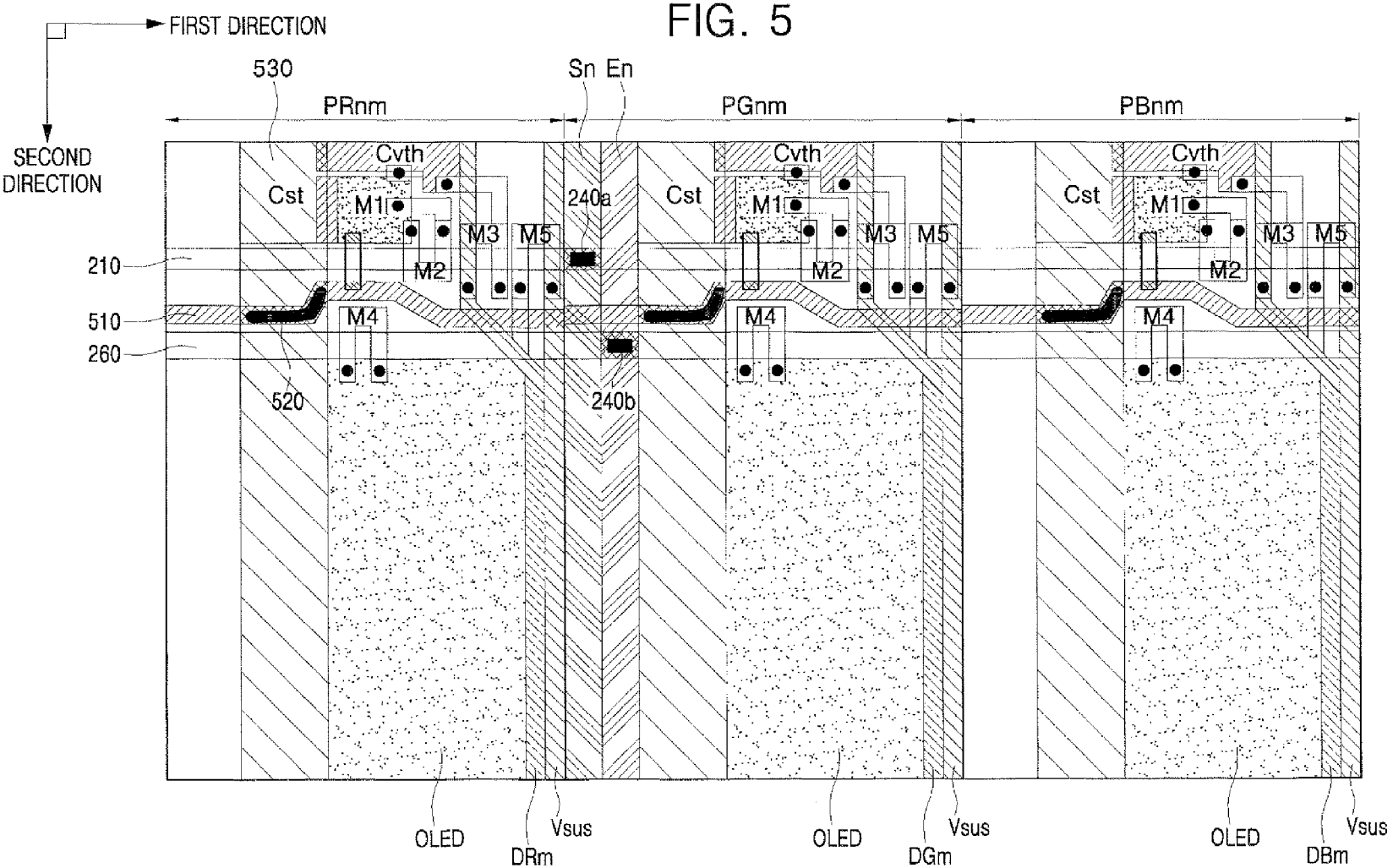
FIG. 5 shows a layout of a pixel according to an exemplary embodiment of the present invention.

FIG. 5 shows the layout of a pixel $P_{nm}$ according to an exemplary embodiment of the present invention.

Referring to FIG. 5, the pixel $P_{nm}$ includes R, G, and B sub-pixels $PR_{nm}$, $PG_{nm}$, and $PB_{nm}$, and each R, G, and B sub-pixel $PR_{nm}$, $PG_{nm}$, and $PB_{nm}$ includes five transistors M1, M2, M3, M4, and M5, two capacitors Cst and Cvth, and an organic light emitting diode OLED.

In FIG. 5, the R, G, and B sub-pixels $PR_{nm}$, $PG_{nm}$, and $PB_{nm}$ are enabled in response to one scan signal and are arranged in the first direction, and the second direction is substantially perpendicular to the first direction.

In each sub-pixel $PR_{nm}$, $PG_{nm}$, and $PB_{nm}$, a conductive line 530, which supplies a positive power supply voltage VDD, and a conductive line Vsus, which supplies an auxiliary power supply voltage, are arranged in the second direction. Also, data lines $DR_m$, $DG_m$, and $DB_m$ for supplying data signals are arranged in the second direction in the sub-pixels $PR_{nm}$, $PG_{nm}$, and $PB_{nm}$, respectively.

Furthermore, a scan line $S_n$ and an emission control line $E_n$ are arranged in the second direction in the G sub-pixel $PG_{nm}$, which is the center sub-pixel among the R, G, and B sub-pixels $PR_{nm}$, $PG_{nm}$, and $PB_{nm}$. The scan line $S_n$ and the emission control line $E_n$ enable pixels $P_{n1}$-$P_{nm}$ disposed in the first direction.

A conductive line 510 is arranged in the first direction in the sub-pixels $PR_{nm}$, $PG_{nm}$, and $PB_{nm}$. The conductive line 510 is coupled with a conductive line 530 and transmits a positive power supply voltage VDD. The conductive lines 510 and 530 are electrically coupled together through contact holes 520 formed in the sub-pixels $PR_{nm}$, $PG_{nm}$, and $PB_{nm}$.

Also, a conductive line 210 and a conductive line 260 are arranged in the first direction in the sub-pixels $PR_{nm}$, $PG_{nm}$, and $PB_{nm}$. The conductive line 210 is coupled with the scan line $S_n$, which is arranged in the second direction in the G sub-pixel $PG_{nm}$, and transmits a scan signal to adjacent pixels arranged in the first direction. Further, the conductive line 260 is coupled with the emission control line $E_n$, which is arranged in the second direction in the G sub-pixel $PG_{nm}$, and transmits an emission control signal to the adjacent pixels arranged in the first direction.

The conductive lines 210 and 260 are electrically coupled with the scan line $S_n$ and the emission control line $E_n$ through contact holes 240*a* and 240*b*, respectively, in the G sub-pixel $PG_{nm}$. The contact holes 240*a* and 240*b* may be formed using a photoresist mask, and the above-described conductive lines 530, Vsus, 510, 210, and 260 may be formed of the same material, for example, molybdenum, a molybdenum alloy, aluminum, or an aluminum alloy. Here, molybdenum has good thermal stability and reliable adhesion with an indium tin oxide (ITO) layer. Molybdenum tungsten is widely used as the molybdenum alloy.

Hereinafter, the transistors M1, M2, M3, M4, and M5, the capacitors Cst and Cvth, and the organic light emitting diode OLED, which are coupled with the interconnections 530, Vsus, 510, 210, and 260, will be described.

The driving transistor M1 controls driving current supplied to the organic light emitting diode OLED. The driving transistor M1 has a source electrode coupled with the conductive line 530 that transmits the positive power supply voltage VDD, a drain electrode coupled with a source electrode of the emission control transistor M4, and a gate electrode coupled with the conductive line 210 that transmits a scan signal.

The emission control transistor M4 is coupled between the driving transistor M1 and the organic light emitting diode OLED. The emission control transistor M4 allows the driving current to flow into the organic light emitting diode OLED or cuts off the driving current in response to an emission control signal applied to its gate electrode.

The organic light emitting diode OLED has a cathode coupled with a conductive line VSS for transmitting a negative power supply voltage, and an anode coupled with a drain electrode of the emission control transistor M4. The organic light emitting diode OLED emits light corresponding to the amount of driving current supplied from the driving transistor M1.

The first switching transistor M3 has a source electrode coupled with the data line DRm, DGm, or DBm, and applies a data voltage Vdata to a first electrode of the capacitor Cst in response to the scan signal that is applied from the conductive line 210 coupled with the transistor M3's gate electrode.

The first electrode of the capacitor Cst is coupled with a drain electrode of the first switching transistor M3, and a second electrode of the capacitor Cst is coupled with the conductive line 510, which transmits the power supply voltage VDD.

The capacitor Cvth has one electrode coupled with the gate electrode of the driving transistor M1, and the other electrode coupled with the first electrode of the capacitor Cst.

The threshold voltage compensation transistor M2 is interposed between the gate and drain electrodes of the driving transistor M1, and it diode-connects the driving transistor M1 in response to an (n−1)-th scan signal.

The second switching transistor M5 is interposed between the conductive line Vsus, which applies an auxiliary power supply voltage, and the first electrode of the capacitor Cst. The second switching transistor M5 applies the auxiliary power supply voltage to the first electrode of the capacitor Cst in response to the (n−1)-th scan signal.

As described above, the first-directional conductive lines and the second-directional conductive lines may be efficiently arranged on the pixel $P_{nm}$ and coupled with one another, so that driving signals may be applied to the pixel $P_{nm}$.

As explained above, exemplary embodiments of the present invention provide an OLED device in which a plurality of EL panels may be bonded to one another. In order to facilitate the bonding of the EL panels, respective data drivers are formed on one side of the pixels, and a scan driver and an emission control driver are formed in each of the EL panels. Thus, the OLED device may be fabricated by bonding surfaces of the EL panels where data drivers are not formed. In the OLED device, a data driver is not formed at interfaces between the EL panels and uniform pixels are arranged, so that non-uniformity in luminance may be prevented.

It will be apparent to those skilled in the art that various modifications and variation can be made in the present invention without departing from the spirit or scope of the invention. Thus, it is intended that the present invention cover the modifications and variations of this invention provided they come within the scope of the appended claims and their equivalents.

What is claimed is:

1. An organic light emitting display device including a plurality of electroluminescent (EL) panels coupled together to display an image, the device comprising:

a pixel portion comprising a plurality of pixels to display an image;

a plurality of data driving circuits spaced apart from one another to transmit a data signal to the pixel portion;

a scan driver arranged between the data driving circuits and the pixel portion, and disposed on a substrate on which the pixel portion is disposed;

an emission control driver arranged between the data driving circuits and the pixel portion, and disposed on the substrate on which the pixel portion is disposed;

a plurality of data lines to transmit the data signal from the data driving circuits to the pixel portion;

a plurality of scan lines extending from the scan driver to the pixel portion to transmit a scan signal to the pixel portion, the scan lines being disposed substantially parallel to the data lines;

a plurality of emission control lines extending from the emission control driver to the pixel portion to transmit an emission control signal to the pixel portion, the emission control lines being disposed substantially parallel to the scan lines; and power supply voltage lines extending from a power supply pad portion to the pixel portion to transmit a power supply voltage to the pixel portion, the power supply voltage lines being disposed substantially parallel to the emission control lines, wherein the power supply pad portion is arranged between adjacent data driving circuits.

2. The device of claim 1, wherein the scan driver comprises a plurality of scan signal generating circuits, which are spaced apart from one another and generate respective scan signals, and wherein the emission control driver comprises a plurality of emission control signal generating circuits, which are spaced apart from one another and generate respective emission control signals.

3. The device of claim 2, wherein a data line is disposed in a space between adjacent scan signal generating circuits and a space between adjacent emission control signal generating circuits.

4. The device of claim 3, wherein the pixel portion comprises a plurality of first conductive lines, which are disposed in a direction crossing the data lines, receive the scan signals from the scan lines, and transmit the scan signals to the respective pixels.

5. The device of claim 4, wherein the pixel portion comprises a plurality of second conductive lines, which are disposed in a direction crossing the data lines, receive the emission control signals from the emission control lines, and transmit the emission control signals to the respective pixels.

6. The device of claim 5, wherein a first power supply voltage line is coupled with third conductive lines, the third conductive lines being arranged in a matrix on the pixel portion to transmit a positive power supply voltage to the respective pixels.

7. The device of claim 1, wherein each EL panel comprises at least two surfaces that are not connected to a data driving circuit, and the at least two surfaces are bonded to adjacent EL panels.

8. An electroluminescent (EL) panel for an organic light emitting display device, which includes a plurality of EL panels coupled together and receives a data signal from a plurality of data driving circuits spaced apart from one another to display an image, the EL panel comprising:

a pixel portion comprising a plurality of pixels to display an image;

a plurality of scan signal generating circuits arranged between the data driving circuits and the pixel portion, spaced apart from one another, and disposed on a substrate on which the pixel portion is disposed;

a plurality of emission control signal generating circuits arranged between the data driving circuits and the pixel portion, spaced apart from one another, and disposed on the substrate on which the pixel portion is disposed;

a plurality of data lines to transmit a data signal from the data driving circuits to the pixel portion;

a plurality of scan lines extending from the scan signal generating circuits to the pixel portion to transmit a scan signal to the pixel portion, the scan lines being disposed substantially parallel to the data lines;

a plurality of emission control lines extending from the emission control signal generating circuits to the pixel portion to transmit an emission control signal to the pixel portion, the emission control lines being disposed substantially parallel to the scan lines; and power supply voltage lines to transmit a power supply voltage to the pixel portion, the power supply voltage lines being disposed substantially parallel to the emission control lines, wherein the power supply voltage lines extend from a power supply pad portion to the pixel portion, the power supply pad portion being arranged between adjacent data driving circuits.

9. The EL panel of claim 8, wherein a data line is disposed in a space between adjacent scan signal generating circuits and a space between adjacent emission control signal generating circuits.

10. The EL panel of claim 9, wherein the pixel portion comprises a plurality of first conductive lines, which are disposed in a direction crossing the data lines, receive scan signals or emission control signals from the scan lines or the emission control lines, respectively, and transmit the scan signals or the emission control signals to the respective pixels.

11. The EL panel of claim 10, wherein a first power supply voltage line is coupled with second conductive lines, the second conductive lines being arranged in a matrix on the pixel portion to transmit a positive power supply voltage to the respective pixels.

12. The EL panel of claim 11, wherein the scan signal generating circuits and the emission control signal generating circuits each comprise a p-type metal oxide semiconductor field effect transistor.

13. An organic light emitting display (OLED) device, comprising:

a plurality of OLED arrays coupled together, an OLED array comprising a data driver coupled with an electroluminescent (EL) panel, wherein the EL panel comprises:

a pixel portion comprising a plurality of pixels to display an image;

a first driver arranged between the data driver and the pixel portion and disposed on the same substrate as the pixel portion;

a second driver arranged between the first driver and the pixel portion and disposed on the same substrate as the pixel portion;

data lines to transmit a data signal from the data driver to the pixel portion;

first lines extending from the first driver to the pixel portion to transmit a first signal to the pixel portion, the first lines being disposed substantially parallel to the data lines; and second lines extending from the second driver to the pixel portion to transmit a second signal to the pixel portion, the second lines being disposed substantially parallel to the first lines.

14. The device of claim 13, wherein the first driver is a scan driver, the first signal is a scan signal, and the scan driver comprises a plurality of scan signal generating circuits that are spaced apart from one another and generate respective scan signals, and wherein the second driver is an emission control driver, the second signal is an emission control signal, and the emission control driver comprises a plurality of emission control signal generating circuits that are spaced apart from one another and generate respective emission control signals.

15. The device of claim 14, wherein the data lines are disposed in a space between adjacent scan signal generating circuits and a space between adjacent emission control signal generating circuits.

16. The device of claim 13, wherein the first driver is an emission control driver, the first signal is an emission control signal, and the emission control driver comprises a plurality of emission control signal generating circuits that are spaced apart from one another and generate respective emission control signals, and wherein the second driver is a scan driver, the second signal is a scan signal, and the scan driver comprises a plurality of scan signal generating circuits that are spaced apart from one another and generate respective scan signals.

17. The device of claim 16, wherein the data lines are disposed in a space between adjacent scan signal generating circuits and a space between adjacent emission control signal generating circuits.

18. The device of claim 13, wherein the OLED array further comprises a power supply pad arranged in a space between a first data driver and a second data driver, and wherein the EL panel further comprises power supply voltage lines arranged substantially parallel to the second lines, the power supply voltage lines to supply a power supply voltage from the power supply pad to the pixel portion.

19. The device of claim 18, wherein the EL panel further comprises:

third lines disposed in a direction crossing the data lines, the third lines receiving the first signal from the first lines to transmit the first signal to respective pixels; and fourth lines disposed in a direction crossing the data lines, the fourth lines receiving the second signal from the second lines to transmit the second signal to respective pixels.

20. The device of claim 19, wherein the EL panel further comprises fifth lines arranged in a matrix on the pixel portion, the fifth lines to transmit a positive power supply voltage from the power supply voltage lines to the respective pixels.

* * * * *

UNITED STATES PATENT AND TRADEMARK OFFICE

CERTIFICATE OF CORRECTION

PATENT NO. : 7,663,577 B2
APPLICATION NO. : 11/460653
DATED : February 16, 2010
INVENTOR(S) : Han-Hee Yoon It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 872 days.

Signed and Sealed this

Thirtieth Day of November, 2010

David J. Kappos

David J. Kappos
*Director of the United States Patent and Trademark Office*